US006149446A

United States Patent [19]

Yu

[11] Patent Number: 6,149,446

[45] Date of Patent: Nov. 21, 2000

[54] SAFETY STRUCTURE OF A THREE-HOLE SOCKET

[76] Inventor: Tsung-I Yu, No. 45, Sec. 3, Pa Te Rd., Pan Chiao City, Taipei, Taiwan

[21] Appl. No.: 09/449,910

[22] Filed: Dec. 2, 1999

[51] Int. Cl.[7] ..... H01R 13/44

[52] U.S. Cl. ..... 439/137; 439/145

[58] Field of Search ..... 439/137, 145

[56] References Cited

U.S. PATENT DOCUMENTS

| | | | |
|---|---|---|---|
| 4,722,693 | 2/1988 | Rose | 439/137 |
| 4,867,694 | 9/1989 | Short | 439/137 |
| 5,006,075 | 4/1991 | Bowden, Jr. | 439/137 |

FOREIGN PATENT DOCUMENTS

| | | | |
|---|---|---|---|
| 2753221 | 6/1978 | Germany | 439/137 |
| 1534602 | 12/1978 | United Kingdom | 439/137 |

*Primary Examiner*—Paula Bradley
*Assistant Examiner*—Tho D. Ta
*Attorney, Agent, or Firm*—Varndell & Varndell, PLLC

[57] ABSTRACT

Safety structure in a three-hole socket assembly, interpreted to be a safety device added into a three-hole socket assembly, to keep an intruding foreign material from coming into contact with the conductor within, thereby preventing electric shock risks; the device is composed of two side-by-side detents overlapped interactively so that they may displace laterally, on one side of each is mounted a pusher whose top tilts downwards internally so that both pushers will cling together, to access power supply the neutral leg of the plug being employed to access power supply will kick the pusher so as to bring the left, right detents being blocked beneath the B plus insert hole and the ground insert hole shifting inwards, just to allow penetration by the other two working legs of the engaging plug into contact with the conductor, whereupon power is accessed in a safe and worry-free manner.

4 Claims, 5 Drawing Sheets

SAFETY STRUCTURE OF A THREE-HOLE SOCKET

BACKGROUND OF THE INVENTION (a) Field of the Invention

Safety Structure of a three-hole socket, more specifically the incorporation of a safety device into a three-hole socket, so that access to power supply is preconditioned by unmaking of the safety device by the insertion of the neutral leg of a three-prong plug, further that the safety device will always block the effort attempted with a foreign material that is being inserted into either the B plus hole or the ground hole, so that the conductor will remain intact and electric shock avoided.

(b) Description of the Prior Art

Considering conventional sockets, including the wallfoot type, fixed not high enough on the wall to deny innocent kids+ easy reach, and the extension type which is often left unattended on the floor, a common dread is that electric shock can break out anytime in the event they, exposed naked, should be tampered with by naughty kids by inserting nail, screwdriver bit, sharp edge of tool or toy into the insert hole thereon, incidents of such nature have occurred so often that they are no longer a surprising news, while on the other hand, that the insert hole is directly linked to the conductor, as is the case with conventional sockets, can easily invite worm inroads or dust buildup therein, that eventually producing negative effects on conductivity performance or oxidation, otherwise damage beyond enumeration.

SUMMARY OF THE INVENTION

The primary object of the invention is to provide a safety structure for three-hole sockets by the provision of a safety device inside the three-hole socket, so that playful attempts made by naughty kids or faulty attempts made by anybody to insert foreign material into any one of the three holes on the socket are checked from coming into contact with the conductor inside, thereby avoiding electric shock incidents, while on the other hand, to gain access to power supply by way of the socket outlet, the user will have to unmake the safety feature by kicking it open with the neutral leg of the plug being employed, so as to force both the left and the right detents which make up the safety device underneath both the B plus hole and the ground hole to yield inwards, so that the two working legs on the plug are allowed into contact with the conductor and the access is made, in a manner sure and safe enough at the same time.

A further object of the invention is to provide the safety structure of a three-hole socket which will frustrate any effort to thrust a foreign material or two singly or concurrently into the working holes, that is, the B plus hole and the ground hole by the blocking effect of the detents, this will largely prevent electric shock otherwise occasioned by the unchecked insertion, committed by naughty kids, using a foreign material, out of curiosity, into the insert hole.

A further object of the invention lies in the provision of a safety feature in a three-hole socket, executed in a detent or tilted shield, applied over the insert hole thereof, serving to seal the aperture so as to prevent entries of dusts or worms so as to keep the interior of the socket clean and clear, with durable conductivity assured.

DETAILED DESCRIPTION OF THE PREFERRED EMBODIMENTS

Figure 1:
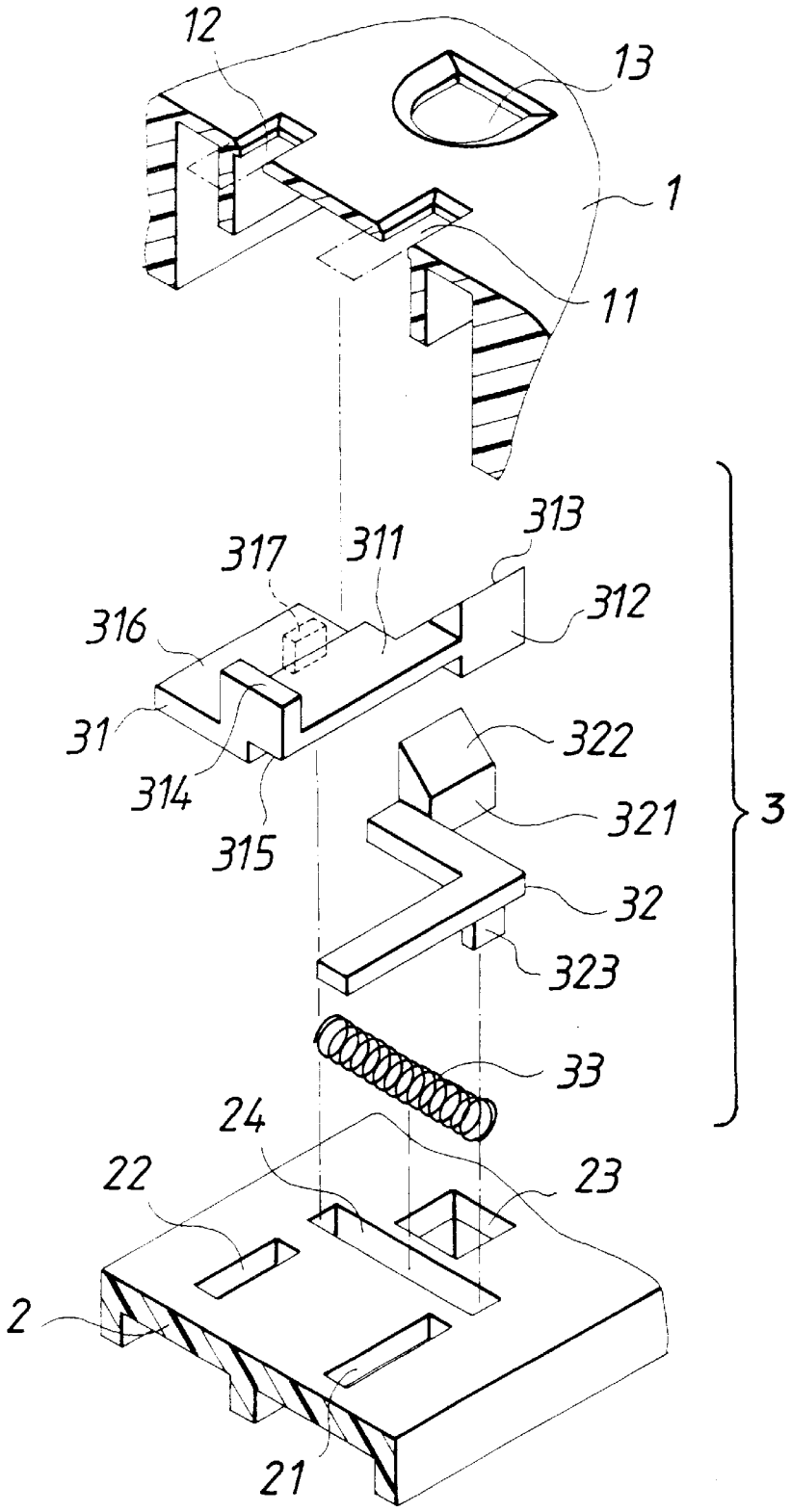
FIG. 1 is a three-dimensional perspective of the invention; exploded analytically.
Figure 2:
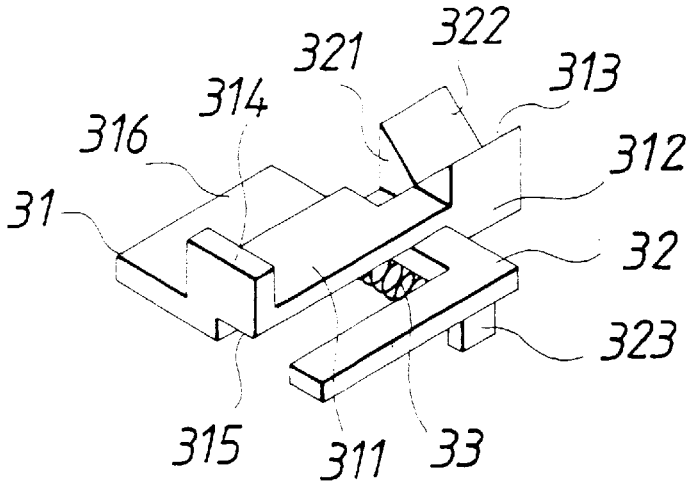
FIG. 2 is a three-dimensional perspective of the safety structure according to the invention.
Figure 3:
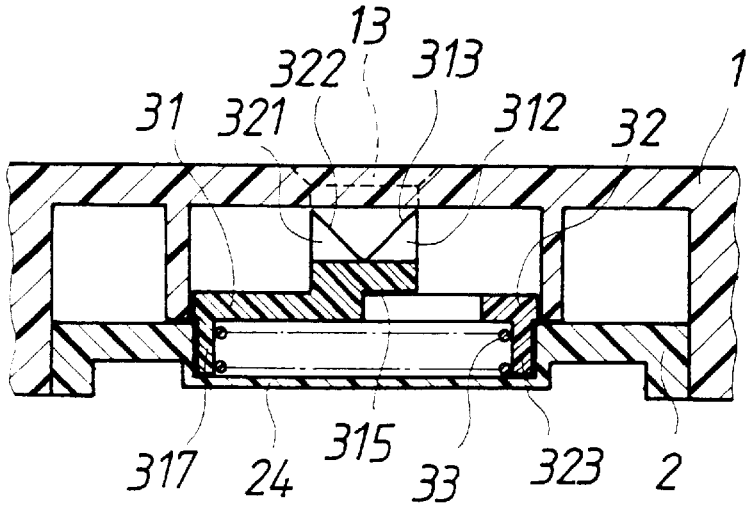
FIG. 3 is a partially taken section view of the invention accomplished of assemblage.
Figure 4:
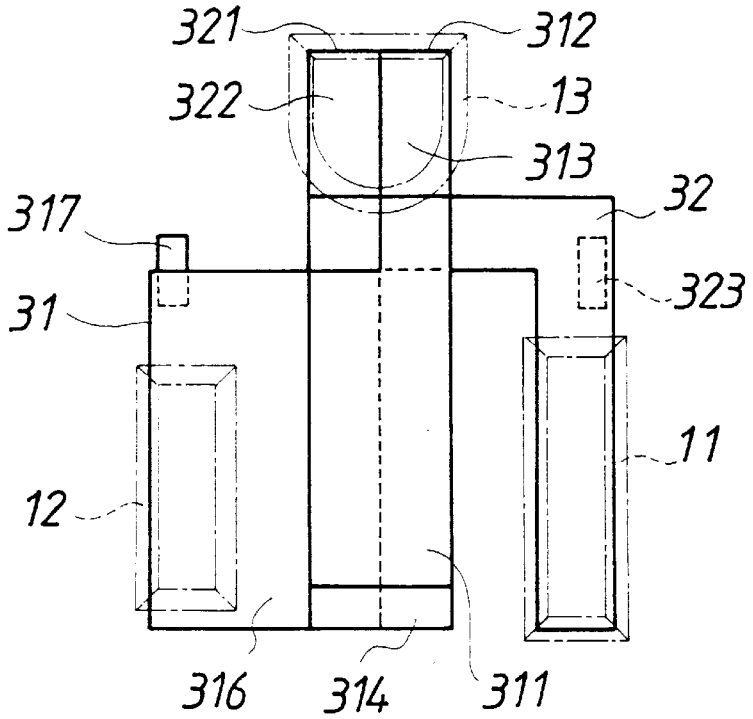
FIG. 4 is an illustration of the invention safety structure laid out flat.

As shown in FIG. 1, FIG. 2, the invention design of a safety structure in a three-hole socket assembly comprises essentially a canopy 1, an inner lid 2 and a safety device 3, whereof:

The canopy 1 is executed to be a covering as applied on a regular fixed type socket or on an extension type socket, comprising, in addition to a grounding hole 11 and a B plus hole 12, semi-circular neutral hole 13 suitably positioned clear of both working holes 11 and 12;

The inner lid 2, executed to be a piece forming a coverture on the conductor of the socket, on which are provided a ground passage hole 21, a B plus passage hole 22 and a neutral passage hole 23 corresponding to each, respective holes provided on the canopy 1, way between the neutral passage hole 23 and the link adjoining the ground passage hole 21 and the B plus passage hole 22 is formed a groove 24;

The safety device 3, comprising a left detent 31, a right detent 32 and a spring 33, is structured such that the left detent 31, being a step member, is flanged with a pusher 312 on one side of the high step section 311, the top of the pusher 312 is formed into a downgoing ramp 313, on the top of the other side of the high step section 311 juts a strut 314, the bottom opposite is formed into a container channel 315, also on one side of the bottom of the low step section 316 of the left detent 31 is formed a rectanguloid shoe 317, the right detent 32 is executed to be an L shape piece, on a forward point of one side thereof is formed a jutting pusher 321 on top of which is formed an inwardly inclined ramp 322, on the bottom of one side of the right detent 32 is formed a rectanguloid shoe 323; the spring 33 is a helicoid compression spring;

To assemble, the left detent 31 and the right detent 32 are united together by overlap match, such as is shown in FIG. 2, so that the right detent 32 is positioned right into the container channel 315 beneath the left detent 31, while the pusher 321 on the right detent 32 just circumvents the pusher 312 on the left detent 31, so that the two pushers 321, 312 are brought abutted upon each other, to bring the ramps 313, 322 on top into a V configuration, while rectanguloid shoes 317, 323 on the bottom of both the left and the right detents 31, 32 confront each other in symmetry, whereupon the spring 33 is set between both rectanguloid shoes 317, 323, so that it will bear upon the interior of both shoes 317, 323 respectively, to the effect that the left and the right detents 31, 32 are displaced outwardly, thereby constituting a safety device 3; the device 3 is then mounted upon the Inner Cover 2, seating both shoes 317, 323 and spring 33 into the groove 24, such as is illustrated in FIG. 3, with the safety device 3 being in an exposed state the left detent 31 just covers up the B plus passage hole 22, while the right detent 32 covers the ground passage hole 21, and the two pushers 321, 312 jointly cover up the neutral passage hole 23; once assembled to completion, with the canopy 1 in place, the neutral hole 13 set right above the midpoint of a straight line conceivably interconnecting both pushers 321, 312, while ground passage hole 11 and B plus passage hole 12 are seated respectively above the left, the right detents 31, 32, as illustrated in FIG. 4 confronting symmetrically the ground passage hole 21 and B plus passage hole 22 down the left detent, right detent 31, 32 respectively, and that consummates a safety structure for a three-hole socket advocated hereunder.

Figure 6:
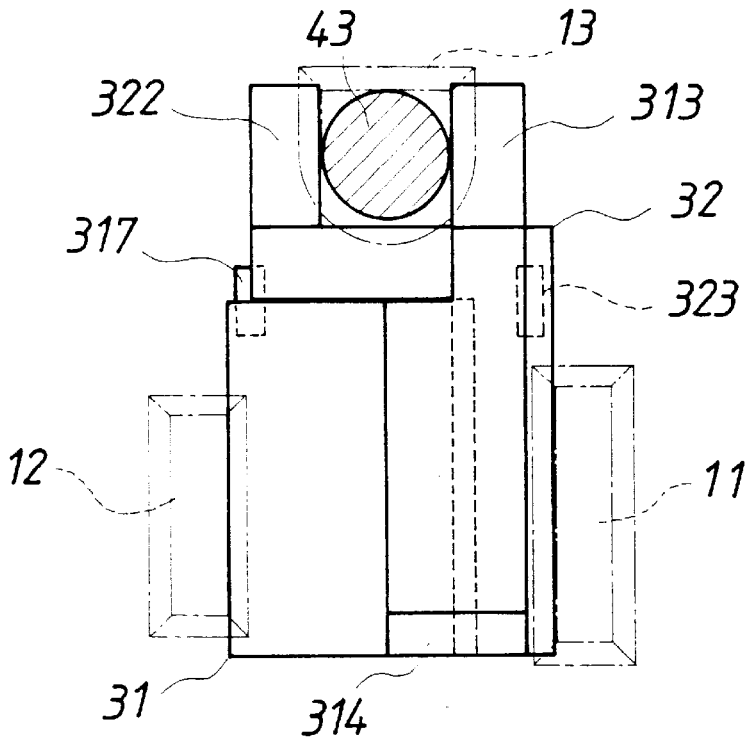
FIG. 6 is a top view of the invention in normal usage.
Figure 7:
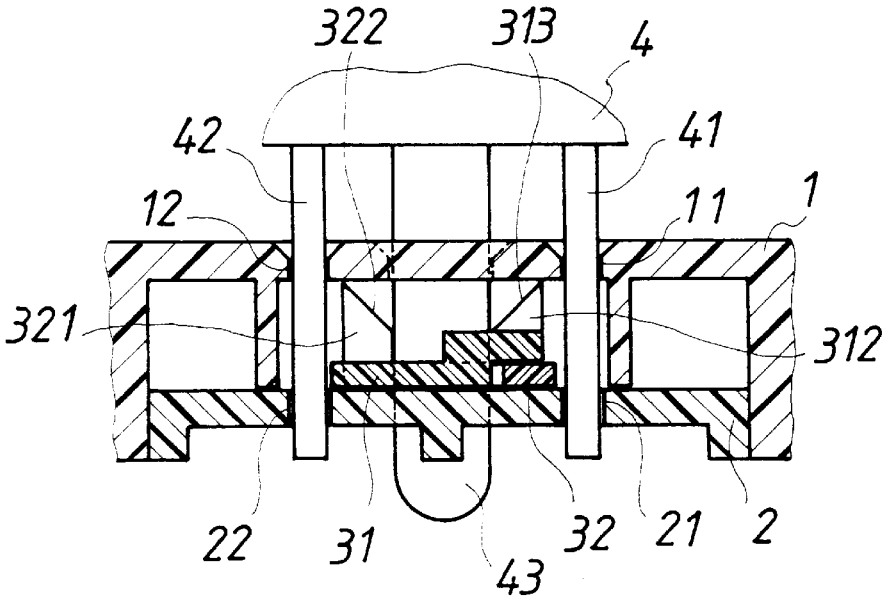
FIG. 7 is a cross section view of the invention in normal usage.

The purpose of the invention is that to access power supply, the user will have to use a three-prong plug 4 for the longer neutral leg 43 of the plug 4 to pass the neutral insert hole 13 on the canopy 1 of the socket, as illustrated on FIG. 6, FIG. 7, in the first place, so that with its pressure bearing upon the ramps 313, 322, the neutral leg 43 will unmake the thus far engaged union of left detent 312 with right detent 321, compelling both detents 31, 32 to move inwardly, eventually exposing the ground passage hole 21 and the B plus passage hole 22 theretofore being covered underneath, whereby the ground passage hole 21, and the B plus passage hole 22, are brought to a state ready to accept incoming ground insert leg 41 and the B plus insert leg 42, and when the insertion is made, ready access to the power supply is consummated on contact with the conductor, this being a normal usage condition, and with user's hand holding the rubber part of the plug 4, risk of electric shock is prevented, while the user pulls up the plug 4, the rebounding force of the spring 33 serves to bring both detents left and right 31, 32 back to a state wherein both resume coverup of both the ground passage hole 21 and the B plus passage hole 22 at the same time.

Figure 5:
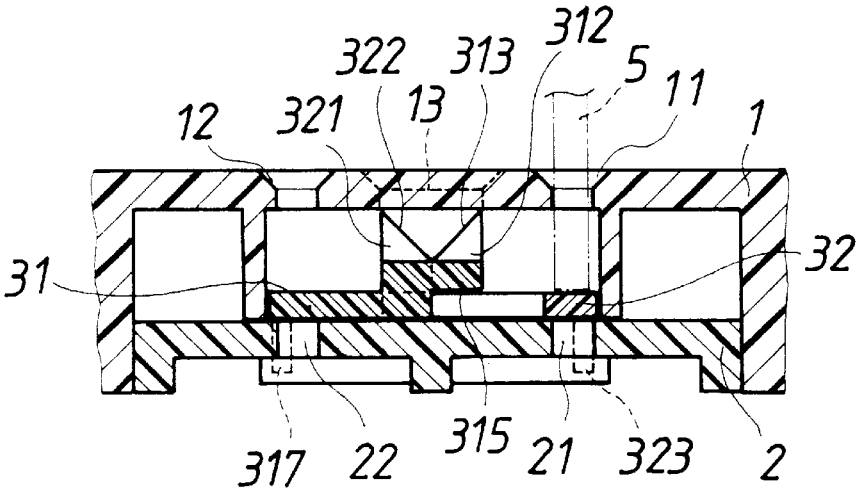
FIG. 5 is an illustration of how the invention checks an intruding foreign material, seen in a cross section view.

In the event innocent or naughty kids should apply a foreign material 5 singly into one of the ground insert hole 11 and the B plus insert hole 12, or concurrently into both holes 11, 12 at the same time, that effort being not potent enough to unbolt the left, right detents 31, 32 of the safety device 3, so the intruding foreign material is blocked off the ground passage hole 21, and the B plus passage hole 22, such as is shown in FIG. 5, that means a risk of electric shock is precluded from the beginning, and there lies the key feature of the invention, for by denying, foreclosing the intrusion of an incoming foreign material unchecked into contact with the conductor due to frustration imposed by a safety means composed of both detents left and right 31, 32 despiting its occupancy into the ground insert hole 21, and the B plus insert hole 22, chances or risks of electric shock are positively ruled out. Moreover, where the intrusion by a foreign material 5 is made with respect to the neutral insert hole 13, although in such an instance the two detents 31, 32, right and left, by which the safety device is embodied may yield to allow passage into the neutral passage hole 23 underneath, the intruder may thus reach the conductor inside the neutral passage hole 23, the very fact that there is no current flowing through the conductor will safeguard the safety feature provided according to the invention all the same, whereby electric shock is precluded altogether. It will be appreciated then that by the design of a safety feature prosecuted according to the invention, embodied equally effective in a wall-foot type socket assembly or in an extension type of socket assembly risks of electric shock to innocent, naughty and playful kids are precluded once for all in so far as the presence of a socket outlet involving a safety concern is concerned. An additional advantage of the design to have both detents left and right 31, 32 of the safety device 3 covering up both the ground passage hole 21 and the B plus passage hole 22 on the inner lid 2 is the prevention of dust buildup inside, so that the intended conductivity performance of the socket is maintained all right, the shielding effect due to the coverup of the conductor within also helps to impede moisture inroads when the socket is installed in a toilet room, electricity leakage is ruled out altogether.

Figure 8:
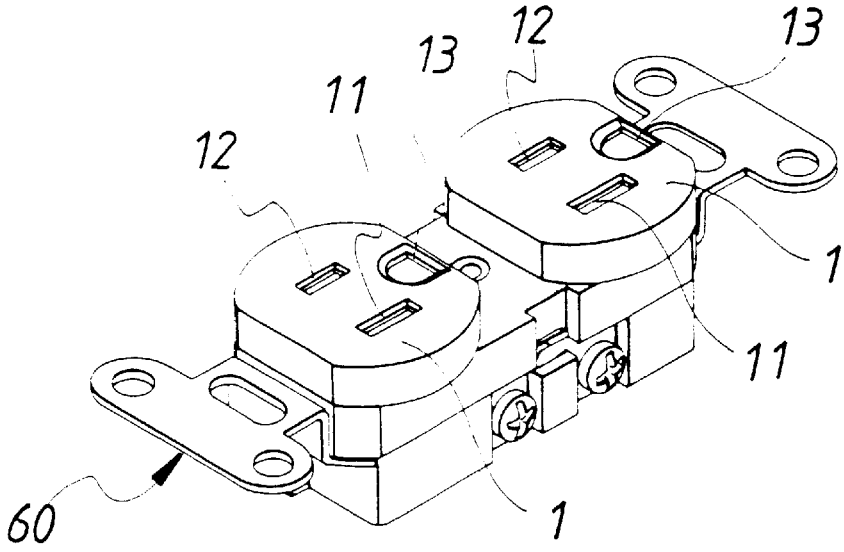
FIG. 8 is an illustration of the invention executed in a fixed type of socket assembly; and, FIG. 9 is an illustration of the invention executed in an extension type of socket assembly.
Figure 9:
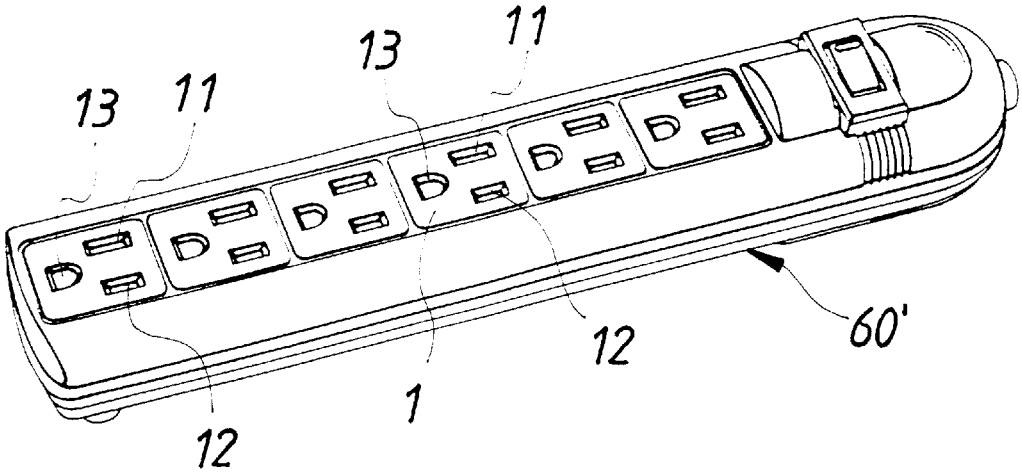

All in all, what this invention teaches and appeals is the structural design of a safety device for incorporation into a three-hole socket, without restriction as to its form of realization, for it may assume the form of a fixed type of socket assembly, as illustrated in FIG. 8, while the invention may be embodied in the form of a fixed type of socket assembly 60, such as that which is shown in FIG. 9, it may just as well be embodied in the form of an extension socket assembly 60', so in short, any variation or substitution prosecuted without departing from the principles disclosed herein should be deemed falling within the context of the invention which is to be limited only by the claims declared in the following.

What is claimed is:

1. A safety structure in a three-hole socket assembly, comprising:

a canopy, an inner lid and a safety device, a surface of the canopy is equipped with a ground hole, a B plus hole and a semi-circular neutral hole located independent of the ground hole and the B plus hole; the inner lid is located between conductors in the three-hole socket assembly and an inner wall of the canopy; on the surface of the inner lid is provided with a ground passage hole, a B plus passage hole and a neutral passage hole, each corresponding with relevant hole provided on the surface of the canopy, characterized in that:

the safety device, comprising a left detent, a right detent and a spring, the safety device is structured such that the left detent being a step member having a high step section and a low step section, a pusher is provided on one side of the high step section, the top of the pusher is formed into a first ramp, a strut is provided on the other side of the high step section, a bottom surface of the high step section is formed into a container channel, also a rectangular shoe is formed on one side of the bottom surface of the low step section of the left detent, the right detent is an L shape piece, a pusher is formed on a forward point of one side of the L shape piece, the top of the pusher of the right detent is formed into a second ramp;

the left detent and the right detent are assembled together by overlap match, so that the right detent is positioned right into the container channel beneath the left detent, while the pusher on the right detent just circumvents the pusher on the left detent, so that the two pushers are brought abutted upon each other, to bring the first and the second ramps into a V shape configuration, the spring seated between both detents to push both detents apart, the safety device is installed on the inner lid of the socket assembly, with both detents of the safety device in a spreadout position just covering up the ground passage hole and the B plus passage hole, and both pushers covering up the neutral passage hole in the meanwhile; the neutral insert hole on the canopy being located just above the midpoint of a straight line interconnecting both pushers, the ground hole and the B plus hole being located respectively above the pusher of the left detent, the pusher of the right detent, in perfect symmetry with the ground passage hole and B plus passage hole underneath, and that consummates a safety structure for a three-hole socket assembly advocated hereunder.

2. The safety structure in a three-hole socket assembly according to claim 1, wherein the rectangular shoe of the low step section to be matched with a rectangular shoe formed on the bottom surface of one side of the right detent by the intervention of the spring seated in-between serving to push apart both detents.

3. The safety structure in a three-hole socket assembly according to claim 1, wherein a transverse groove is provided between the neutral passage hole and an interlink interconnecting the ground passage hole and the B plus passage hole on the inner lid.

4. The safety structure in a three-hole socket assembly according to claim 3, wherein the rectangular shoe of the low step section to be matched with a rectangular shoe formed on the bottom surface of one side of the right detent by the intervention of the spring seated in-between serving to push apart both detents.

* * * * *